United States Patent [19]

Putness

[11] Patent Number: 4,905,951

[45] Date of Patent: Mar. 6, 1990

[54] QUICK INSERT AND QUICK RELEASE TOOL HOLDER

[76] Inventor: Carl M. Putness, 129 W. Potomac Ave., Lombard, Ill. 60148

[21] Appl. No.: 160,594

[22] Filed: Feb. 26, 1988

[51] Int. Cl.[4] ..... A47G 29/08

[52] U.S. Cl. ..... 248/316.1; 24/633; 24/665; 211/66; 211/70.6; 211/89; 248/113; 403/16

[58] Field of Search ..... 248/113, 110, 316.2, 248/316.3, 316.1, 309.1; 211/70.6, 68, 65, 66, 89; 403/16; 24/612, 665, 633

[56] References Cited

U.S. PATENT DOCUMENTS

| | | | |
|---|---|---|---|
| 1,540,291 | 6/1925 | Sessions | 248/316.3 X |
| 2,381,340 | 8/1945 | Eastman | 248/316.3 X |
| 2,457,274 | 12/1948 | Rifken | 248/316.1 X |
| 2,590,297 | 3/1952 | Curtis II | 248/316.3 |
| 3,096,960 | 7/1963 | Kinney | 248/316.3 X |
| 3,365,761 | 1/1968 | Kalvig | 211/65 X |
| 3,603,551 | 7/1971 | Peterson | 211/70.6 X |
| 4,433,459 | 2/1984 | Molina | 24/633 X |
| 4,597,496 | 7/1986 | Kaplan | 211/89 X |

FOREIGN PATENT DOCUMENTS

| | | | |
|---|---|---|---|
| 987641 | 3/1965 | United Kingdom | 211/66 |
| 2038613 | 7/1980 | United Kingdom | 248/316.3 |

*Primary Examiner*—David L. Talbott

*Attorney, Agent, or Firm*—Lee, Mann, Smith, McWilliams & Sweeney

[57] ABSTRACT

A quick insert and quick release tool holder for gripping the handle of a tool, or the like. The tool holder has a disk-shaped flexible friction holder with a central aperture for gripping around a tool handle. A release mechanism is operable by the use of only one hand to expand the aperture and release the tool handle.

6 Claims, 2 Drawing Sheets

QUICK INSERT AND QUICK RELEASE TOOL HOLDER

BACKGROUND AND SUMMARY OF THE INVENTION

The invention generally relates to a tool holder for conveniently storing and arranging tools in a workshop, janitor's closet, and the like. More specifically, the invention relates to a tool holder that permits quick insert and quick release of the handle of a tool and which may be operated with just one hand.

In particular, the invention is very useful for the storage and accessibility of janitorial tools, such as brooms, brushes, mops, and the like, to aid in the efficient operation by building maintenance crews.

Conventional tool holders employ spring clamps, rubber wedge-shaped grips for resiliently receiving a tool handle, and also wire loop-type holders. One disadvantage is that generally only one size tool handle can be accommodated by these devices. Smaller sizes cannot be tightly held and larger sizes often overextend the holding portions to the point of being unusable thereafter. Typically, the clamp-type or wedge-type holding devices require a janitor, for example, to force the handle into the resilient grip of the holder by pushing it in a direction toward the wall on which the tool holder is mounted. Generally both hands are needed to be used to effectively engage the tool handle with the holder.

Spring biased locking clamps for tubular members and the like have sometimes employed a mechanical grip that is controlled by a cooperative coiled spring, as in U.S. Pat. Nos. 2,563,040 issued to Junkunc and 2,467,842 issued to Marx. Canted washer-like disks that frictionally grip a movably adjustable slide tube, when urged into an oblique angle relative to the tube, are also well known to the art; examples of these are U.S. Pat. Nos. 2,806,723 issued to Fairclough and 2,703,690 issued to Petrick et al.

Permanent peripheral clamp disks that annularly grip around an item are shown in U.S. Pat. No. 2,798,748 issued to Moore where a bowed clamping disk encircles a tube, or the like, and is thereafter urged into a flat shape to provide a non-releasable permanent attachment as a substitute for conventional lock keys on a shaft. In U.S. Pat. No. 3,007,726 issued to Parkin, a fastener similar to the device disclosed in Pat. No. 2,798,748 is shown, but includes two sets of tongues: one set of tongues bites into a cavity wall of a holder ferrule; and, a central aperture has another set of tongues to grip an inserted item, such as an end of a rod or the like. The devices disclosed by Parkin and Moore are not releasable and are intended to prevent withdrawal of the fastened item.

Another use of a flexible disk is shown in U.S. Pat. No. 4,566,680 issued to Schlegel et al. In this apparatus, a support tube is vertically adjustable and arranged within a guide tube for attachment to a work bench. Flexible disks hold a cylinder within a tube sleeve in non-positive contact with the sleeve so that there is movable frictional contact with the wall of the sleeve in order to act as a guiding disk structure. None of the known prior art provides for a quick insert and quick release tool holder that offers a resilient friction holder exerting inward radial force to grip a tool handle. Further, heretofore none has shown the quick releasability in such a device wherein a release tube may be activated to widen a flexed gripping aperture to abate an inward radial force and thereby release the tool holder. The prior art devices have failed to attain the advantage of permitting the user to facilitate an efficient quick insert and quick release requiring the use of only one hand.

In overcoming the problems found in the prior art, it would be desirable to provide a tool holder that can accommodate tool handles of various sizes.

It would be a further advantage if the tool holder could be operated by just one hand leaving the other hand free.

It would be very beneficial to provide a tool holder that can be used for not just heavy brooms and mops, but also may be used for other smaller tools as well.

It would be a further benefit to provide a tool holder that requires only a simple upward movement on the tool handle to resiliently engage the tool in place.

It would be additionally advantageous for a homeowner to have a tool holder that may be made to include an outwardly pleasing design and appearance, so that one or more tool holders might be used in a broom closet, workroom, garage wall or laundry room, where a certain degree of neatness and aesthetically pleasing appearances are often sought for organizing household equipment.

The present invention solves these problems, and achieves its desired results, by the provision of a tool holder that has a canister-like housing conformation with a downwardly open receiving aperture for the entrance of the end of a tool handle for the support thereof. A convenient release lock lever extends from the canister whereby the user may release a tool with just one hand so that the tool handle may be gripped with the fingers while the thumb operates the release mechanism when the tool is needed to be released for use.

The tool holder may be briefly summarized as comprising an upper bonnet with an interior chamber. The bonnet attaches to a lower body having a downwardly open bore. A resilient friction holder for gripping a tool handle is clamped against a support ring by the thread-engagement of the bonnet attaching to the lower body. An axially moving release tube is supported by the support ring but is upwardly movable by a pivotable release member that is arranged with a downwardly extending arm. The arm extends below the body facilitating operation by the user's hand by means of simply pressing the thumb against the arm connecting the release member. The resilient friction holder has a central aperture, preferably with radial slits extending therefrom. Upon the receipt therethrough of an upwardly moved tool handle, the aperture distends and grips around the tool handle. The release tube cooperates with the resilient friction holder and is capable of being driven upwardly thereagainst by the pivoting of the pivotable release member to expand the aperture and release the grip around the tool handle.

At an upper region of the interior chamber of the bonnet a cushion stop is arranged to be abutted by the end of an inserted tool handle so that damage is avoided and whereby the janitor can feel when the tool handle is fully engaged.

DETAILED DESCRIPTION OF A PREFERRED EMBODIMENT OF THE INVENTION

Figure 1:
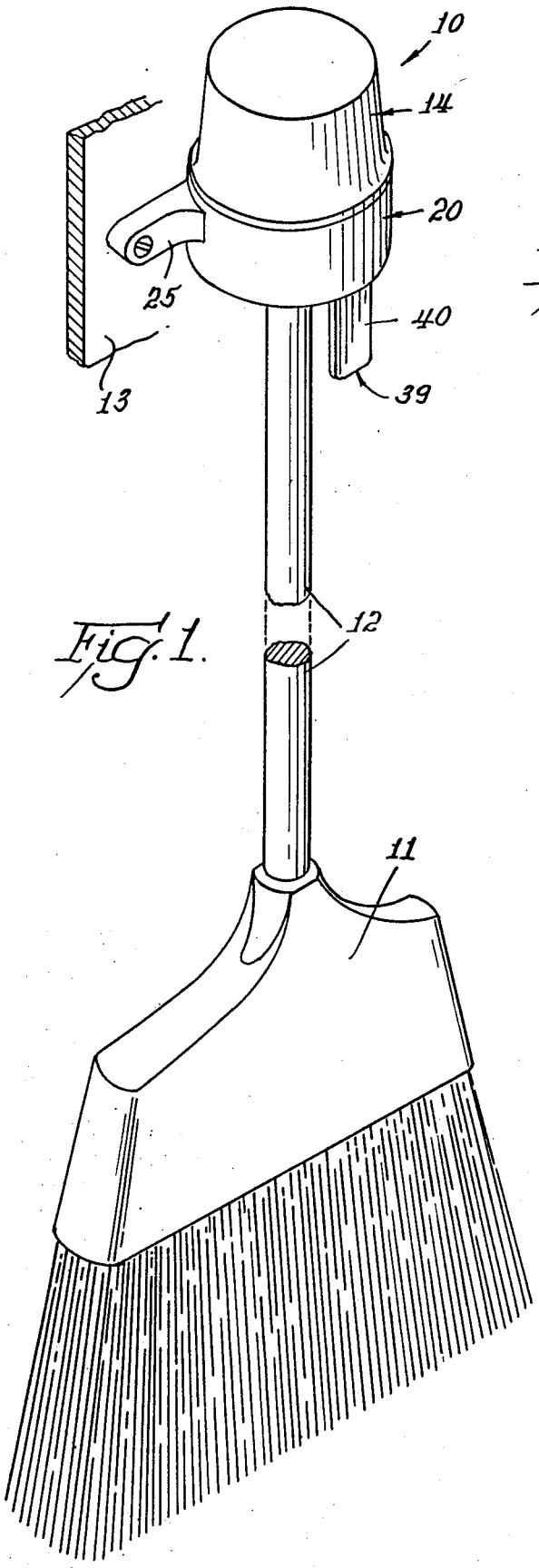
FIG. 1 is a perspective view showing the inventive tool holder supporting a broom and wherein the tool holder is mounted to a wall so that the broom is vertically supported.

Turning first to FIG. 1, a preferred form for the tool holder of the instant invention is generally indicated by reference numeral 10. The tool holder 10 supports a broom 11 along its handle 12 in a generally vertical arrangement adjacent a wall 13 onto which the tool holder 10 is mounted.

Figure 2:
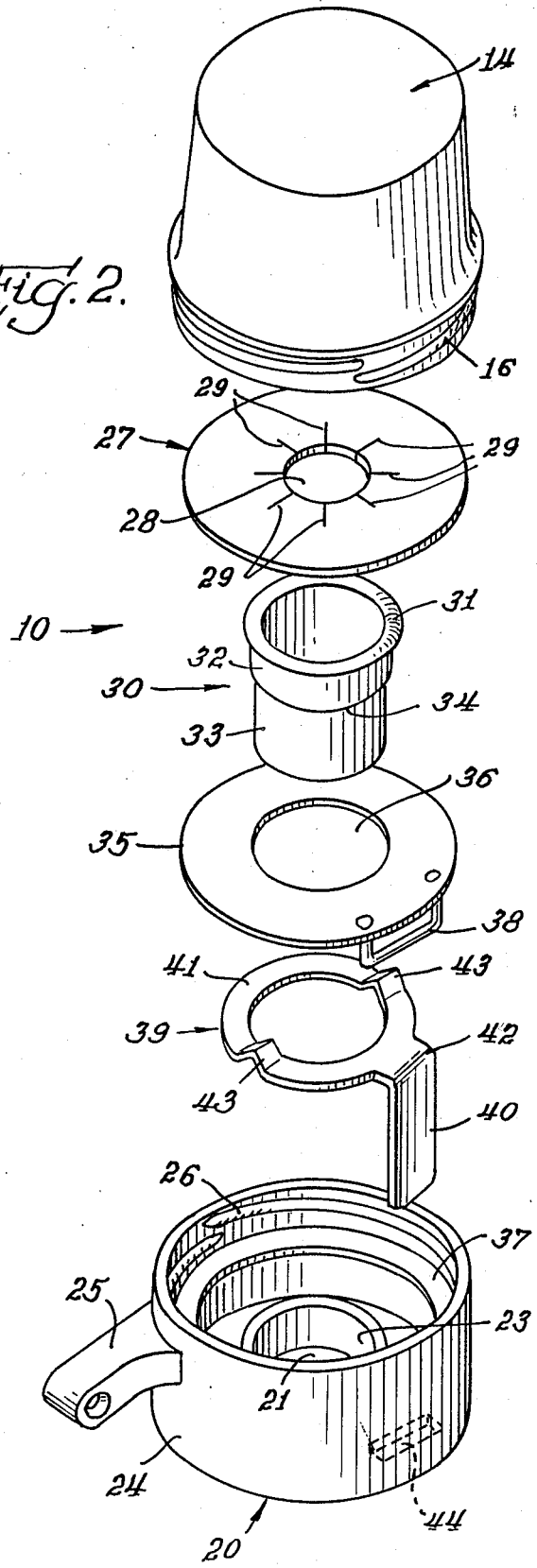
FIG. 2 is an exploded view of the tool holder of FIG. 1 showing the internal mechanism thereof for releasably holding a tool handle.

In FIG. 2, the tool holder 10 is illustrated in an exploded view showing the internal components facilitating the quick insert and quick release provisions of the invention.

An upper bonnet 14 of the tool holder 10 has a generally cup-shape and defines a chamber 15 therein. A threaded bottom 16 forms the lower portion of the bonnet 14. A cushion stop 17, preferably comprising a resilient closed cell foam, synthetic sponge-material, or equivalent, is attached interiorly of the chamber 15 generally at the underside of a top wall 18 of the bonnet 14. A tough flexible pad 19 may be adhered to the under surface of the cushion stop 17. The bonnet 14 forms the upper portion of the exterior configuration of the tool holder 10 in cooperation with a lower body 20 forming the lower portion of the exterior configuration. The body 20 includes a central bore 21 through a bottom wall 22 thereof. The bore 21 is formed with an upstanding collar 23 therearound extending upwardly from the bottom wall 22. A circular sidewall 24 forms the side of the body 20 and extends upwardly from the bottom wall 22. A wall mounting bracket 25 is formed with the sidewall 24 whereby to enable the body 20 to be attached to the wall 13, for example by conventional screw fasteners, as shown in FIG. 1. On the inside, and generally around the top of the sidewall 24, a threaded portion 26 is provided for thread engagement with the threaded bottom 16 of the bonnet 14.

The thread engagement of the bonnet 14 with the lower body 20 holds the internal components in operational alignment. Firstly, a resilient friction holder 27 is, as best viewed in conjunction with the cross-sectional views of FIGS. 3 and 4, secured by the threaded bottom 16 of the bonnet 14. The resilient friction holder 27 is disk-shaped having a central receiving aperture 28 therethrough. In the preferred embodiment, radial slits 29 are cut radially outwardly of the receiving aperture 28 to achieve greater flexibility when a tool handle is being received therethrough as will be further explained below. In the disclosed embodiment, eight radial slits 29 are provided at 45 degree spacings therebetween and have a length, measured radially, approximately equal to the diameter of the receiving aperture 28, which has a diameter sufficient for receipt of standard mop and broom handles, in the range of from about ½ inch to about 1 ¼ inches. Of course, for other tools and equipment, the diameter can vary, and it it envisioned that the inventive tool holder 10 may be provided in appropriate dimensions such as to be used for holding pencils, artist's brushes, pens, craft tools, other mechanical implements, and the like.

The flexible material provided for the resilient friction holder 27 is preferably a durable flexible-type material such as a tough plastic, like polyethylene, or a neoprene material. One material well-suited for the resilient friction material holder 27, is a well known red rubber sheet gasket material which is available through Sear's stores hardware departments. A plastic of course cannot be rigid, but must be flexible to be upwardly distended and radially stretched to facilitate gripping around, as shown in the exemplary embodiment, the tool handle 12. The grip of the resilient friction holder 27 is released by a release tube 30 that is movable in the axial direction upwardly against the friction holder 27 around the aperture 28 to widen the receiving aperture 28 for the release of a tool handle 12.

The release tube 30 is formed to have a twin diameter construction and a top lip 31 provided to abut against the resilient friction holder 27 around the receiving aperture 28. The top lip 31 is the upper periphery of a first tube portion 32 having a cylindrical shape with a first, or large, diamenter. A second tube portion 33 having a smaller diameter is joined to the first portion 32 at a rebated annular shoulder 34. The diameter of the second tube portion 33 generally corresponds to the largest diameter tool handle size intended to be accommodated.

Figure 3:
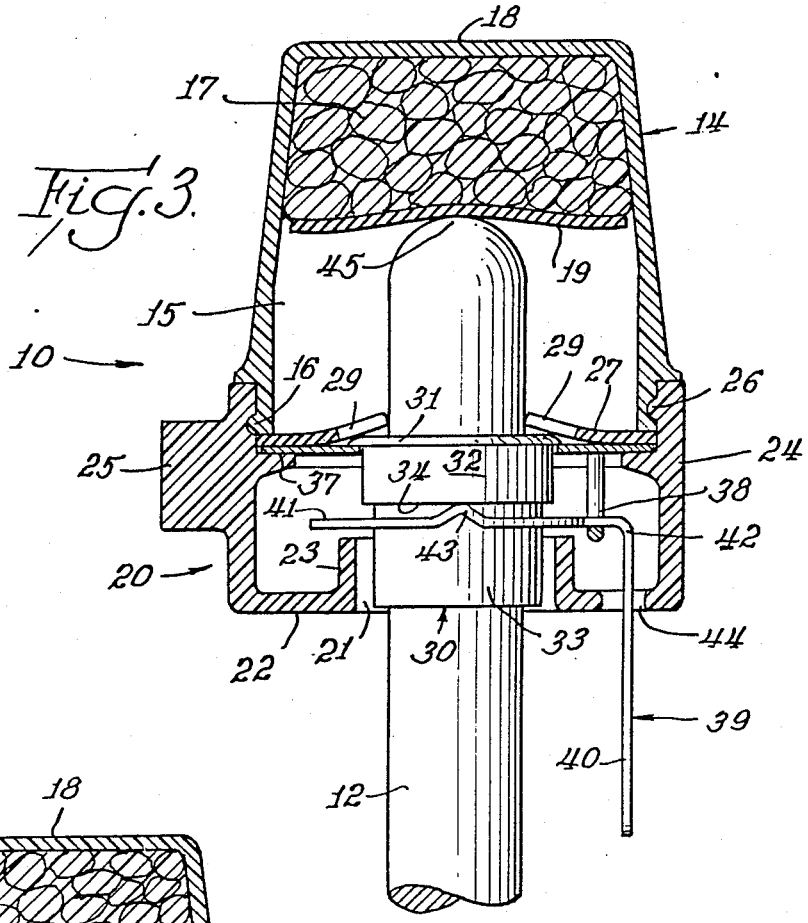
FIG. 3 is a central vertical sectional view of the tool holder showing a tool handle held therein; and, FIG. 4 is also a central vertical section showing the release mechanism in operation whereby the tool handle may be retracted from resilient engagement when needed.

The release tube 30 is is supported by a donut-shaped support ring 35 having a central opening 36 capable of receiving the first tube portion 32 therethrough and supporting thereunder the top lip 31 as best viewed in the cross section of FIG. 3. The first tube portion 32 of the release tube 30 may freely move upward and downward through the central opening 36 but is detained from further downward movement as the lip 31 reaches the support ring 35.

Figure 4:
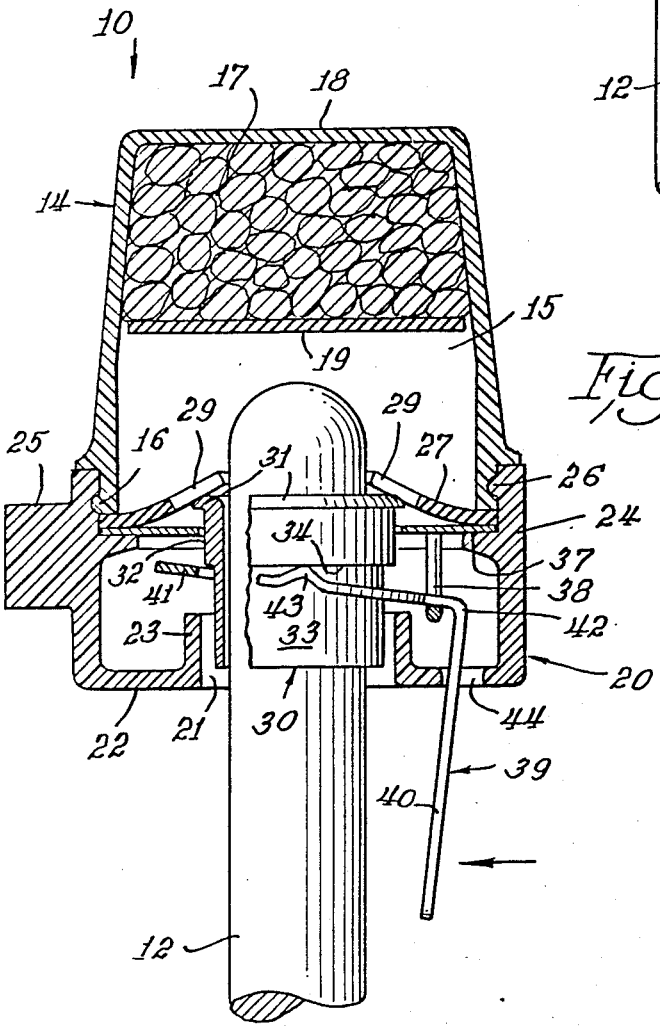

The support ring 35 is held in fixed position upon the thread engagement of the bonnet 14 to the lower body 20 by the provision of an annular ledge 37 extending radially inwardly of the sidewall 24 of the body 20 to create a peripheral support around the support ring 35 as shown in FIGS. 3 and 4. It will also be seen that the circumference of the resilient friction holder 27 is clamped onto the support ring 35 when the bonnet 14 is thread engaged to the lower body 20. Accordingly, the support ring 35 and resilient friction holder 27 are clamped downwardly by the bottom edge of the threaded bottom 16 of the bonnet 14 so that as the receiving aperture 28 is distended or widened during the receipt of the tool handle 12, the circumferential peripheral portion of the resilient friction holder 27 remains clamped in a fixed arrangement.

In the disclosed embodiment, a hanger bracket 38 depends from the support ring 35 in a location generally at 180 degrees to the attachment of the tool holder 10 to the wall at the wall mounting bracket 25. The hanger bracket 38 is generally U-shaped and provides for the support of the release member 39.

The release member 39 is the manual actuating member for the movement of the release tube 30 in order to facilitate the quick release of the broom 11. The release member 39 includes a downward arm 40 and a transverse pivoting ring 41 extending around and below the shoulder 34 of the release tube 30 as will be explained.

The downward arm 40 joins the pivoting ring 41 at a joinder portion 42, which may be described as a curved elbow-shaped portion provided to be pivotally supported on the hanger bracket 38, as best viewed in FIGS. 3 and 4. The pivotal rotation of the pivoting ring 41 begins at an at rest position shown in FIG. 3. As force is applied to the downward arm 40, indicated by the arrow in FIG. 4, it moves to the rotated position shown in FIG. 4 to move the release tube 30. Pushing in the direction of the arrow pivots the release member 39 around the joinder 42 portion. The pivoting ring 41 extends from the hanger bracket 38 below the support ring 35 and underneath the shoulder 34 of the release tube 30. In preferred form, the release member 39 is provided with a pair of diametrically positioned protruding ribs 43 that are struck upwardly from the plane of the pivoting ring 41 to lightly contact the shoulder 34 when in the at rest position shown in FIG. 3. The protruding ribs 43 aid in evenly driving the release tube 30 upwardly in the axial direction by applying force at generally corresponding diametrically opposed points along the shoulder 34. A plurality of protruding ribs 43, or the like, that are spaced around the support ring 35 might also be employed. One skilled in the art will understand that the height and spacing of the ribs 43 would be determined in conjunction with the diameter of the receiving aperture 28 and the material chosen for the resilient friction holder 27. This is because the expansion and contraction of the receiving aperture 28 can vary among different materials and therefore the required distance that the release tube 30 would need to travel to unlock a tool handle from engagement with the resilient friction holder 27 would likewise vary.

The downward arm 40 projects from the lower body 20 to be generally spaced parallel to the tool handle 12 whereby with one hand the user may grip the tool handle 12 and push with the thumb against the downward arm 40 for the release of the tool handle 12. A slot 44 is provided through the bottom wall 22 of the lower body 20 for accommodating the downward arm 40 therethrough, as best viewed in FIG. 2. The slot 44, taken in the radial direction, provides space sufficient for the downward arm 40 to move from the at rest position of FIG. 3 to the inwardly moved pivoted position shown in FIG. 4 in order to to drive the release tube 30 upwardly the appropriate distance to open the receiving aperture 20 for the release of the tool handle 12.

When the tool holder 10 is fully assembled the threaded bottom 16 of the bonnet 14 is thread engaged with the threaded top 26 of the lower body 20, and the resilient friction holder 27 is clamped along its circumferential, or peripheral, portion between the threaded bottom 16 and the support ring 35. The release member 39 rests in the arrangement as shown in FIG. 3 and the downward arm 40 extends in generally a vertical direction with the transverse pivoting ring 41 generally parallel to the shoulder 34. In preferred form, the tool holder 10 is designed to support a broom 11, or the like, to hang in a vertical fashion, but the practice of the invention is not limited to supporting tools or implements only in a vertical orientation.

In use, the tool holer 10 is capable of receiving and gripping the tool handle 12 upon upwardly urging the handle 12 through the release tube 30. The release tube 12 opens downwardly from within the bore 21 of lower body 20 wherein the second tube portion 33 preferably terminates coplanar with the bottom wall 22 of the lower body 20. The tool handle 12 then moves upwardly until its upper end, at 45, impacts the flexible skin 19 at the cushion stop 17 which prevents damage to the tool holder and also indicates to the user that the tool handle is properly in position. During the upward motion of the tool handle 12, the receiving aperture 28 is widened as the resilient friction holder 27 is flexed upwardly, as shown in FIG. 3. Upon the abutment of the end 45 with the cushion stop 17, the user may let go of the broom 11 as a radial inward gripping force is effected by the receiving aperture 28 as the material seeks to contract and return to the at rest position caused in part, by the downward frictional pull of the hanging broom 11. As would be clear, the aperture size, and the thickness and flexibility of the material may be designed to take into account the handle sizes and weights of the items to be held. A variety of configurations and dimensions can be used for various environments. The central aperture 28 is not limited to a circular shape nor is the invention limited to securing tools with circular handles.

When the broom 11 is needed for sweeping, the janitor simply grasps the tool handle 12 with one hand, and with the thumb of the same hand, pushes in the direction of the arrow as shown in FIG. 4 against the downward arm 40. The pivoting ring 41 pivots at the joinder 42 to drive the protruding ribs 43 upwardly against the shoulder 34 and moves the release tube 30 upwardly. The top lip 31 of the release tube 30 drives upwardly against the resilient friction holder 27 around the circumference of the receiving aperture 28 to elastically re-enlarge the receiving aperture 28 to the point at which the inward radial force is not sufficient enough to hold the broom 11 and it falls by gravity downwardly to the user's hand. The release, of course, can be achieved without gripping the tool handle 12 by simply pushing against the downward arm 40. In any event, one hand is all that is required to quickly release a tool that is held.

In preferred form, the support ring 35, release tube 30, and release member 39, are formed of a light gauge steel. The bonnet 14 and the lower body 20 may be economically made of a molded durable plastic such as polyvinyl chloride, polysulfone, or equivalent, but can be made of most any solid material. The materials for the components are not limited to the preferred embodiment and those skilled in the art will see the opportunity to form the components of the invention in a variety of suitable materials.

It will also be clear that the tool holder 10 may be upsized or downsized for use with larger or smaller tools, and is not limited for use with janitorial equipment such as mops, brooms, shovels and the like. In this regard, the connection of the bonnet 14 to the lower body 20 is not limited to a thread engagement and might otherwise be engaged, for example, by snap-over fastening, clips, bayonet-like clasps, etc.

Accordingly, a wide range of equivalent structures falls within the ambit of the claims appended hereto:

What is claimed is:

1. A tool holder comprising:

a disk-shaped flexible member having a circular aperture, the flexible member associating with means for peripherally clamping the flexible member therearound, said aperture capable of resiliently expanding to grip around a tool handle when axially inserted therethrough in one direction; and, release means for pushing against the flexible member around the circular aperture in the same axial direction as during insertion of a tool handle held therein whereby to increase the aperture size to release the tool handle, said release means comprises a pivoting release member and a tube member, said tube member having an upper annular portion being larger in diameter than said circular aperture and capable of being moved by said pivoting release member upwardly against the flexible member around the circular aperture to expand the circular aperture.

2. A tool holder as claimed in claim 1 wherein said release means is tube-like shaped and comprises an upper portion having a first diameter and a lower portion having a smaller diameter, said upper and lower portions joined at a circular shoulder, the means for moving the movable release means comprising a pivoting ring being pivotal against said shoulder to urge said movable release means upwardly against said flexible member.

3. A tool holder as claimed in claim 2 wherein said pivoting ring includes upward protruding ribs for contact against said shoulder.

4. A quick insert and quick release tool holder for gripping the handle of a tool, or the like, the tool holder comprising:

a hollow upper bonnet member;

a hollow lower body releasably attached to the upper bonnet member and defining a chamber therein, the lower body having an interior ledge means therearound;

a disk-shaped flexible member having a central aperture therethrough, said flexible member being peripherally clamped inside said defined chamber;

a release tube means below said flexible member, the release tube means having an upper lip, the upper lip having a diameter larger than the aperture of the flexible member and arranged for contact against the flexible member, said release tube means being upwardly movable;

support ring means holding said release tube means in freely movable axial relationship therewith, said support ring means including a peripheral portion extending underneath said flexible member and the peripheral portion being atop said interior ledge means of said lower body, said support ring means including a bracket means depending therefrom;

a release member having a manually operable pivot arm joined to a pivoting ring, said release member being pivotally supported by the bracket means of said support ring means, the pivoting ring extending around said release tube means and being in movable contact therewith whereby upon manually operating the pivot arm the pivoting ring pivots to contact and urge said release tube means upwardly to contact the flexible member and expand the aperture thereof, said pivot arm extending downwardly from said lower body through a slot in said lower body.

5. A quick insert and quick release tool holder as claimed in claim 4 wherein the flexible member has radial slits extending from said central aperture.

6. A quick insert and quick release tool holder as claimed in claim 4 wherein in the pivoting ring of said release member includes upwardly protruding rib means for movable contact against said release tube means.

* * * * *